US006121225A

United States Patent [19]

Britton et al.

[11] Patent Number: 6,121,225

[45] **Date of Patent: *Sep. 19, 2000**

[54] STABLE AQUEOUS ENZYME COMPOSITIONS

[75] Inventors: Larry N. Britton, Spicewood; Geoffrey L. Russell, Round Rock; Allen M. Nielsen, Austin, all of Tex.

[73] Assignee: CONDEA Vista Company, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/217,923

[22] Filed: Dec. 21, 1998

[51] Int. Cl.[7] ..... C11D 1/72; C11D 1/94; C11D 7/42

[52] U.S. Cl. ..... 510/392; 510/300; 510/321; 510/337; 510/346; 510/350; 510/351; 510/356; 510/358; 510/359; 510/360; 510/370; 510/374; 510/405; 510/421; 510/426; 510/433; 510/530

[58] Field of Search ..... 510/276, 299, 510/300, 320–321, 337, 346, 350, 351, 356–360, 370, 374, 392–393, 405, 421, 426, 433, 530

[56] References Cited

U.S. PATENT DOCUMENTS

| | | | |
|---|---|---|---|
| 3,586,715 | 6/1971 | Smeets | 260/535 |
| 3,925,262 | 12/1975 | Laughlin et al. | 252/526 |
| 3,929,678 | 12/1975 | Laughlin et al. | 252/526 |
| 4,101,457 | 7/1978 | Place et al. | 252/559 |
| 4,111,855 | 9/1978 | Barrat et al. | 252/545 |
| 4,170,565 | 10/1979 | Flesher et al. | 252/93 |
| 4,243,546 | 1/1981 | Shaer | 252/174.12 |
| 4,261,868 | 4/1981 | Hora et al. | 252/529 |
| 4,305,837 | 12/1981 | Kaminsky et al. | 252/174.12 |
| 4,318,818 | 3/1982 | Letton et al. | 510/393 |
| 4,404,115 | 9/1983 | Tai | 252/135 |
| 4,537,707 | 8/1985 | Severson, Jr. | 252/545 |
| 5,071,586 | 12/1991 | Kaiserman et al. | 252/174.12 |
| 5,269,960 | 12/1993 | Gray et al. | 252/174.12 |
| 5,386,045 | 1/1995 | Weerasooriya et al. | 554/149 |

FOREIGN PATENT DOCUMENTS 1354761 6/1974 United Kingdom .

*Primary Examiner*—Mark Kopec
*Assistant Examiner*—Brian P. Mruk
*Attorney, Agent, or Firm*—Browning Bushman

[57] ABSTRACT

A stabilized aqueous enzyme composition comprising water, from about 0.1% to about 75% by weight of a detergent surfactant selected from the group consisting of anionic surfactants or anionic surfactants and one or more non-anionic detergent actives, from about 0.001% to about 10% by weight proteolytic enzyme, and an effective amount of an enzyme stabilizer having the formula:

$$X—O—(C_nH_{2n}O)_a—H \quad [I]$$

wherein "X" is an organic radical having from 14 to 22 carbon atoms, "a" is an integer from 10 to 26, and "n" is an integer from 2 to 4, and provided that "X" has a hydrophobicity similar to a linear alkyl group having from 14 to 22 carbon atoms.

11 Claims, 3 Drawing Sheets

ENZYM ACTIVITY REMAINING (% NPU/ml)
120
100
80
60
40
20
0
ALKYL CHAIN LENGTH
18
16
14
12
10
8
6
ETHYLENE OXIDE (%)
50
60
70
80

STABLE AQUEOUS ENZYME COMPOSITIONS

BACKGROUND OF THE INVENTION

1. Field of the Invention

The present invention relates to stable aqueous enzyme compositions and, more particularly, to such compositions for use in heavy-duty liquid detergents.

2. Description of the Prior Art

Heavy-duty liquid detergents (HDLs) are rapidly becoming the detergents of choice. Many of these HDLs are formulated using enzymes, particularly proteolytic enzymes. The use of proteolytic enzymes in HDLs is complicated by their limited stability in aqueous solutions, particularly when the HDLs contain an anionic surfactant, such as, for example, a linear alkylbenzene sulfonate (LAS), an alcohol sulfate (AS), a secondary alkane sulfonate (SAS), an alpha olefin sulfonate (AOS), etc. These and other anionic surfactants are known to destabilize commercial proteolytic enzymes (proteases). In particular, since LAS has become the most widely used anionic surfactant, the enzyme compatibility problem in liquid formulations has become synonymous with the use of LAS.

In order to effectively use LAS or other anionic surfactants in HDLs, it has become common practice to use stabilizers. Examples of stabilized compositions of proteolytic enzymes are disclosed in U.S. Pat. Nos. 5,071,586; 4,305,837; and 4,318,818, to mention a few. Thus, U.S. Pat. No. 5,071,586 discloses a stabilized composition that employs propionic acid or a propionic acid salt capable of forming propionic acid, the composition being built and having a pH greater than 8.5, preferably 9.0 and above. U.S. Pat. No. 4,305,837 discloses the use of a low molecular weight primary or secondary alcohol together with a short-chain-length carboxylic acid salt, preferably a formate as a stabilizer, while U.S. Pat. No. 4,318,818 uses a similar stabilizing system.

As is typified by the above patents, the solution to stabilizing HDL-containing enzymes, particularly proteolytic enzymes, has been to add compounds that, for the most part, serve no useful function other than to act as a stabilizer or inhibitor to prevent loss of activity of the enzyme. Thus, while these inhibitor or stabilizing systems are effective for their intended purpose, they add cost to the composition without imparting any beneficial effect other than to prevent loss of activity of the enzyme.

It would clearly be desirable to have stable aqueous enzyme compositions wherein the stabilizing agent or compound, over and above preventing loss of activity of the enzyme, contributed to the efficiency of the composition, e.g., exhibited surfactant properties.

SUMMARY OF THE INVENTION

It is therefore an object of the present invention to provide a stable aqueous enzyme composition.

Another object of the present invention is to provide a stable aqueous enzyme composition that employs a stabilizer that is a surfactant.

The above and other objects of the present invention will become apparent from the drawings, the description given herein, and the claims.

The stable, aqueous enzyme composition of the present invention includes water, from about 0.1% to about 75% by weight of a detergent surfactant selected from the group consisting of anionic surfactants or anionic surfactants and one or more non-anionic detergent actives, from about 0.001% to about 10% by weight proteolytic enzyme, and an effective amount of an enzyme stabilizer having the general formula:

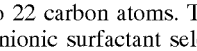

$$X—O—(C_nH_{2n}O)_{a—H} \quad [I]$$

wherein "X" is an organic radical having from 14 to 22 carbon atoms; "a" is an integer from 10 to 26 and "n" is an integer from 2 to 4, and provided that "X" has substantially a hydrophobicity similar to a linear alkyl group having from 14 to 22 carbon atoms. The enzyme stabilizer is preferably a nonionic surfactant selected from the class consisting of compounds having the formula:

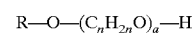

$$R—O—(C_nH_{2n}O)_a—H \quad [II]$$

wherein "R" is a linear or branched alkyl group having from 14 to 22 carbon atoms; compounds having the formula:

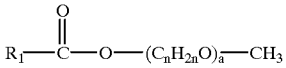

$$R_1—\overset{\overset{O}{\|}}{C}—O—(C_nH_{2n}O)_a—CH_3 \quad [III]$$

wherein $R_1$, is a linear or branched alkyl group having from 13 to 21 carbon atoms; compounds having the formula:

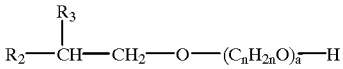

$$R_2—\overset{\overset{R_3}{|}}{CH}—CH_2—O—(C_nH_{2n}O)_a—H \quad [IV]$$

wherein "$R_2$" and "$R_3$" are linear or branched alkyl groups having, in the aggregate, from 14 to 22 carbon atoms; and compounds having the formula:

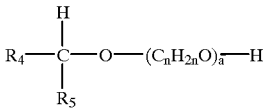

$$R_4—\overset{\overset{H}{|}}{\underset{\underset{R_5}{|}}{C}}—O—(C_nH_{2n}O)_a—H \quad [V]$$

wherein "$R_4$" and "$R_5$" are linear or branched alkyl groups having, in the aggregate, from 14 to 22 carbon atoms and mixtures thereof.

DESCRIPTION OF THE PREFERRED EMBODIMENT

Figure 1:
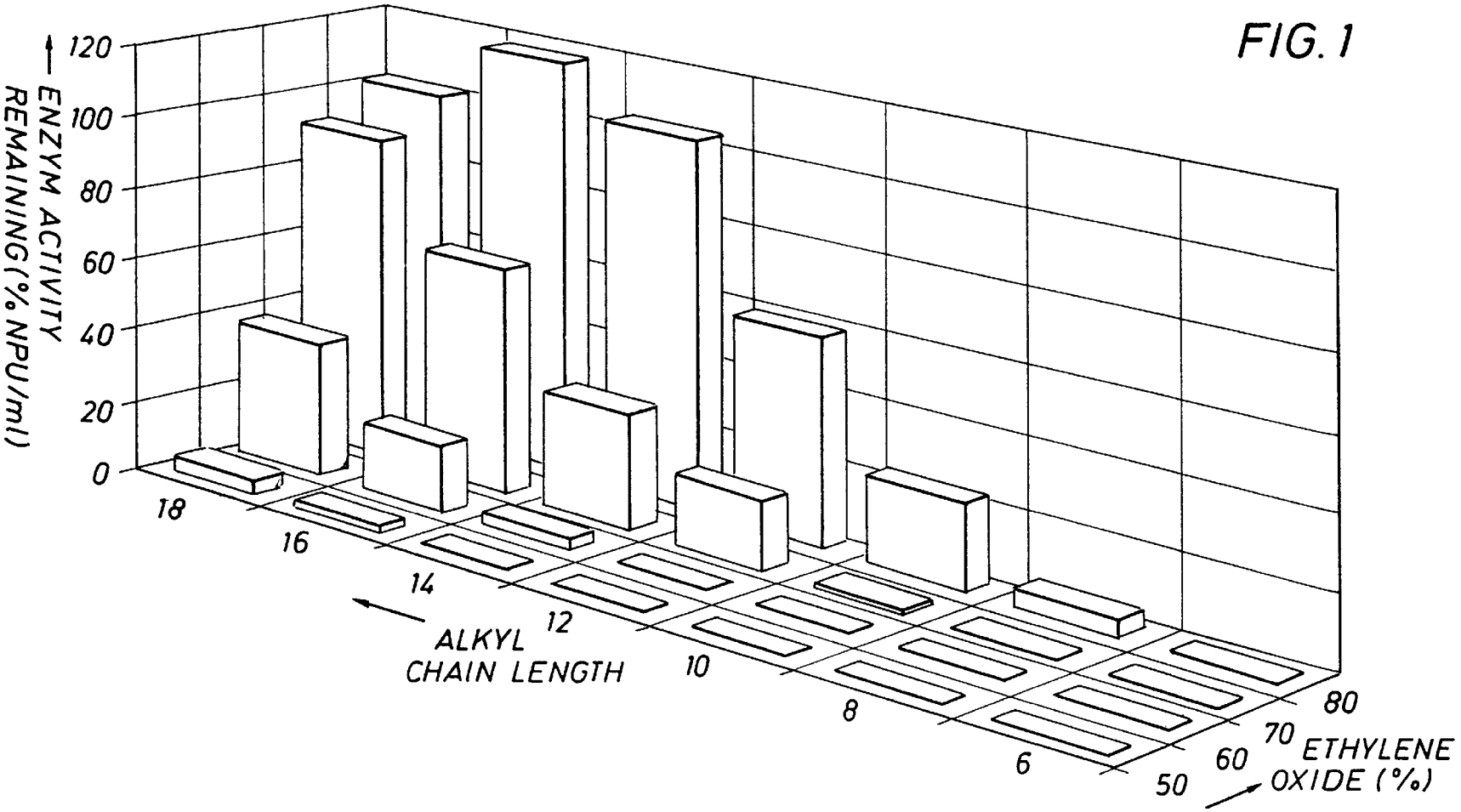
FIG. 1 is a three-axis bar graph showing the effect of various enzyme stabilizers of the present invention on protease stability in liquid detergent formulations containing LAS.

The present invention is based on the unexpected finding that by incorporating a certain narrowly defined class of compounds that are generally considered to be nonionic surfactants into an aqueous enzyme composition containing a proteolytic enzyme and an anionic surfactant or a mixture of an anionic surfactant and a non-anionic detergent active, the stability of the enzyme composition is markedly enhanced.

The term "non-anionic detergent actives" is intended to include nonionic surfactants, cationic surfactants, zwitterionic surfactants, ampholytic surfactants, semi-polar nonionic surfactants, and mixtures thereof. Such non-anionic surfactants are well known to those skilled in the art, as exemplified by U.S. Pat. Nos. 4,305,837 and 4,243,546, both of which are incorporated herein by reference for all purposes.

The compositions of the present invention will contain from 0.1% to about 75% by weight of a detergent surfactant that is an anionic surfactant or a mixture of an anionic surfactant and one or more non-anionic detergent actives wherein, preferably, in the case of a mixture of an anionic surfactant and a non-anionic detergent active, the ratio of anionic surfactant to non-anionic active, by weight, is greater than 1:1.

Anionic Surfactants

Non-limiting examples of the anionic detergents or surfactants are salts (including sodium, potassium, magnesium, calcium, ammonium, and substituted ammonium salts such as mono-, di-, and triethanolammonium salts) of 9 to 20 carbon alkylbenzenesulfonates, 8 to 22 carbon primary or secondary alkane sulfonates, 8 to 24 carbon olefinsulfonates, sulfonated polycarboxylic acids prepared by sulfonation of the pyrolyzed product of alkaline earth metal citrates; e.g., as described in British Patent Specification No. 1,082,179, 8 to 22 carbon alkyl sulfates, 8 to 24 carbon alkyl polyglycol-ether-sulfates, -carboxylates, and -phosphates (containing up to 10 mols of ethylene oxide).

The stable aqueous enzyme compositions of the present invention are particularly directed to compositions containing synthetic anionic surfactants represented by the general formula $R^xSO_3^-M^+$wherein "RE" represents a hydrocarbon group selected from the group consisting of straight or branched alkyl radicals containing from about 8 to about 24 carbon atoms and alkyl phenyl radicals containing from about 9 to 15 carbon atoms in the alkyl group and "M" is a salt-forming cation, which typically is selected from the group consisting of sodium, potassium, ammonium, monoalkanolammonium, dialkanolammonium, trialkanolammonium, and magnesium, and mixtures thereof, and by the formula $R_YCOOM$, wherein $R_y$ is a linear or branched chain alkyl group containing 9–17 carbon atoms. Preferred synthetic anionic surfactants are water-soluble salts of an alkyl benzene sulfonic acid containing from about 9 to about 15 carbon atoms in the alkyl group. Other anionic surfactants include water-soluble salts of alkyl polyethoxylated ether sulfates wherein the alkyl group contains from about 8 to about 24, preferably from about 10 to about 18, carbon atoms, and there are from about 1 to about 20, preferably from about 1 to about 12 ethoxy groups. Still other suitable anionic surfactants are disclosed in U.S. Pat. No. 4,170,565, incorporated herein by reference. Further examples of suitable anionics are described in "Surface Active Agents and Detergents" (Vol. I and II, Schwartz, Perry, and Berch). It will be apparent that virtually any anionic surfactant may be used, and the above examples are not intended to be limiting in any way.

Non-anionic Detergent Actives

Non-limiting examples of nonionic synthetic detergents or surfactants that may be used in the compositions of the present invention are the condensation products of ethylene oxide, propylene oxide, and/or butylene oxide, with alkylphenols wherein the alkyl group contains from 8 to 18 carbon atoms, 8 to 18 carbon primary or secondary aliphatic linear and/or branched chain alcohols, 8 to 18 carbon fatty acid amides. Further examples of nonionic surfactants include tertiary amine oxides with one 8 to 18 carbon alkyl chain and two 1 to 3 carbon alkyl chains. Again, any suitable nonionic may be used, and the examples above are not intended to be limiting in any way. Generally speaking, the average number of mols of alkylene oxide, e.g., ethylene oxide and/or propylene oxide, present in the above nonionic surfactants varies from 1 to 30 or greater.

Non-limiting examples of zwitterionic surfactants include derivatives of aliphatic quaternary ammonium, phosphonium, and sulfonium compounds in which the aliphatic moiety can be straight- or branch-chained and wherein one of the aliphatic substituents contains from about 8 to 24 carbon atoms and one contains an anionic water-solubilizing group. Particularly preferred zwitterionic materials are the ethoxylated ammonium sulfonates and sulfates well known to those in the art as disclosed in U.S. Pat. No. 3,925,262 and 3,929,678, said patents being incorporated herein by reference.

The ampholytic surfactants that maybe employed include derivatives of aliphatic heterocyclic secondary and tertiary amines in which the aliphatic moiety can be straight-chained or branched and wherein one of the aliphatic substituents contains from about 8 to about 24 carbon atoms and at least one aliphatic substituent contains an anionic water-solubilizing group.

Non-limiting examples of semi-polar nonionic surfactants include water-soluble amine oxides containing one alkyl or hydroxyalkyl moiety of from about 8 to about 28 carbon atoms, and two moieties selected from the group consisting of alkyl groups and hydroxyalkyl groups, containing from about 1 to about 3 carbon atoms that can optionally be joined in ring structures, water-soluble phosphine oxides containing one alkyl or hydroxy alkyl moiety of from about 8 to about 28 and two moieties selected from the group consisting of alkyl groups and hydroxy alkyl groups, containing from about 1 to about 3 carbon atoms, and water-soluble sulfoxides containing one alkyl or hydroxy alkyl moiety of from about 8 to about 28 carbon atoms, and a moiety selected from the group consisting of alkyl and hydroxy alkyl moieties of from 1 to 3 carbon atoms.

The enzymes employed in the composition of the present invention will be present in an amount of from about 0.001% to about 10% by weight. In particular, the enzymes contemplated are the proteases used in detergent compositions, such proteases being commonly referred to as serine proteases, alkaline proteases, or subtilisins (indicating a derivative of the historical protease known as subtilisin Carlsberg). As is well known, these proteolytic enzymes include many species that are known to be adapted for use in detergent compositions and, in fact, have been used in detergent compositions. Sources of such proteolytic enzymes include commercial enzyme preparations such as SAVINASE 16L, sold by Novo Industries, A/S, Copenhagen, Denmark, and MAXATASE, sold by Gist-Brocades, Delft, The Netherlands, which contain from about 10% to about 20% enzyme. Other preferred enzyme compositions include those commercially available under the trade names SP-72 ("Experase"), manufactured and sold by Novo Industries, and "AZ-Protease," manufactured and sold by Gist-Brocades. Those skilled in the art are familiar with other proteolytic enzymes suitable for use in the compositions of the present invention as evidenced, for example, in U.S. Pat. No. 4,101,457, incorporated herein by reference for all purposes.

Water comprises from about 1% to about 90% by weight of the total composition. The amount of water present will vary depending upon the amount of surfactant and whether and to what extent the other optional ingredients are added. The preferred amount of water is from about 40% to about 60% by weight.

As noted above, the enzyme stabilizers of the present invention comprise a defined class of alkoxylated nonionic surfactants that, unlike alkoxylated nonionic surfactants in general, show a marked ability to stabilize or prevent loss of activity of proteolytic enzymes such as described above in aqueous enzyme compositions containing anionic surfactants and used to formulate HDLs. In general, the enzyme stabilizers have the general formula:

$$X—O—(C_nH_{2n}O)_a—H \quad [I]$$

wherein "X" is an organic radical having from 14 to 22 carbon atoms, "a" is an integer from 10 to 26, and "n" is an integer from 2 to 4, preferably 2. As noted above, the organic radical comprising the "X" group has similar, preferably substantially the same, hydrophobicity as a linear alkyl group having from 14 to 22 carbon atoms. Thus, the organic radical, i.e., "X," can contain other heteroatoms, such as would be found in ether linkages, carbonyl structures, etc. In general, "X" will not contain any group or groupings that affect its hydrophobicity to the extent that it does not behave, in general, as a hydrophobic linear alkyl group having from 14 to 22 carbon atoms. Preferably, the enzyme stabilizers are selected from the class consisting of compounds having the formula:

$$R—O—(C_nH_{2n}O)_a—H \quad [II]$$

wherein "R" is a linear or branched alkyl group having from 14 to 22 carbon atoms; compounds having the formula:

[III]

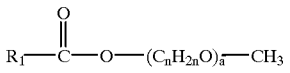

wherein $R_1$ is a linear or branched alkyl group having from 13 to 21 carbon atoms; compounds having the formula:

[IV]

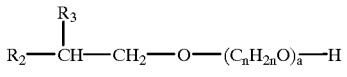

wherein "$R_2$" and "$R_3$" are linear or branched alkyl groups having, in the aggregate, from 14 to 22 carbon atoms; and compounds having the formula:

[V]

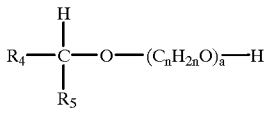

wherein "$R_4$" and "$R_5$" are linear or branched alkyl groups having, in the aggregate, from 14 to 20 carbon atoms, and mixtures thereof It will be apparent that the "R," "$R_1$," "$R_2$," "$R_3$," "$R_4$," and "$R_5$" groups can be linear or branched.

The alkoxylated methyl esters represented by Formula III can be prepared by methods well known to those skilled in the art, such as, for example, by the method disclosed in U.S. Pat. No. 5,386,045, incorporated herein by reference for all purposes. Likewise, the alkoxylated Guerbet alcohols represented by Formula IV can also be prepared by methods well known to those skilled in the art.

The enzyme stabilizer will be present in an effective amount-i.e., an amount sufficient to significantly retard loss of activity of the proteolytic enzyme in an anionic-surfactant-containing formulation. It will be appreciated that the amount of enzyme stabilizer that is used according to the present invention will depend upon the presence vel non of other, prior art stabilizers, the desired shelf life of the composition, the intended use of the composition, and other such variables. In general, the enzyme stabilizer to anionic surfactant is from about 4:1 to about 1:5, preferably from about 2:1 to about 1:5.

The pH of the aqueous stable enzyme compositions will generally be from around 6 to 7, it being appreciated that when the aqueous compositions are further formulated into end-use detergents, the pH of wash solutions containing such end-use formulations is generally in the range of 8 to 10.

In addition to one or more of the enzyme stabilizers set out above, the stable aqueous enzymes compositions of the present invention can also incorporate other compounds that are known stabilizers for anionic-containing surfactants. Non-limiting examples of such stabilizers include borax, carboxylic acids, a combination of carboxylic acids and simple alcohols, a combination of borax and polyols, glycerol in mixture with a hydrolyzed and solubilized collagen, etc. Examples of protease inhibitors used to maintain storage stability are disclosed in U.S. Pat. Nos. 4,261,868; 4,243,546; 4,305,837; 4,404,115; 4,537,707; and4,318,818 and British Patent No. 1,354,761, all of which are incorporated herein by reference, to mention a few.

It will be appreciated that the compositions of the present invention can contain a series of further optional ingredients that are mostly used in additive levels, usually below about 5% by weight. Examples of such additives include polyacids, foaming regulants, opacifiers, antioxidants, bactericides, dies, perfumes, brighteners, and the like. Formulating end use HDLs combining such optional ingredients with the compositions of the present invention is well within the skill of those in the art.

To more fully illustrate the present invention, the following non-limiting examples are presented. In all of the examples, the enzyme employed was a protease marketed as SAVINASE 16L by Novo Industries. Enzymatic activity was assayed by following the hydrolysis of the chromophoric substrate azocasein as per the procedure of the manufacturer. Specifically, 1.0 mL aqueous samples containing SAVINASE 16L in 16×1.25 mm culture tubes were placed in a 40° C. water bath. After several minutes of temperature equilibration, 5.0 mL of azocasein substrate (0.6% by weight in 0.2 M TRIS [Tris-hydroxymethylaminomethane] buffer [pH 8.5]) were rapidly added with mixing, and the resulting mixed solution was incubated for 30 minutes. Five (5) mL of 5% by weight trichloroacetic acid was rapidly added after the 30 minute incubation period to terminate the enzyme activity, and the resulting azocasein was separated by centrifugation and decanting the clear supernatant liquid. Absorbances at 390 nm were recorded on the supernatant liquid on a HACH spectrometer, and enzyme activity was calculated by referencing a calibration curve of absorbances versus units of activity of standard Novo SAVINASE 1 6L reported as possessing 16.7 KNU (kilo Novo units) per mL. The SAVINASE 16L used in the examples was the same as that supplied to detergent manufacturers and was a straw-colored liquid containing propylene glycol and other proprietary, stabilizing compounds. In the following examples and throughout the disclosure, all percentages are by weight unless otherwise indicated. Unless otherwise indicated, the LAS was a $C_{12}$ (dodecyl) benzene sulfonate, sodium salt.

Example 1

A series of alcohol ethxoylates sold by CONDEA Vista Company under the trade name ALFONIC were tested at a ratio of one mol of alcohol ethoxylate (AE) to two mols of LAS (dodecyl benzene sulfonate, sodium salt). The AEs varied in alcohol residual carbon chain length from $C_6$ to $C_{18}$ and in ethoxylate content from 50–80% by weight (roughly 10 to 26 ethoxy [EO] units, depending upon the carbon chain length of the alcohol residue). The LAS concentration in all samples was 2.88 mM, while the AE concentration was adjusted according to the molecular weight of the AE to give the desired molar ratio of two mols of LAS per mol of AE. FIG. 1 shows the percentage of the original protease activity remaining after 24 hours at 40° C. in the various mixtures. Although not shown, there was no remaining activity when LAS was used alone, i.e., without any AE. The data in FIG. 1 clearly show that there is a critical carbon chain length (hydrophobe) and ethoxylate (alkoxylate) content to obtain the desired protection against loss of protease activity. In general, and as the data in FIG. 1 show, the carbon chain length—i.e., the "X" group as to Formula I—should contain from 14 to 22 carbon atoms, especially from 14 to 20 carbon atoms, and the AE should contain from 60–80% ethoxylate by weight, generally corresponding to an average of 12 to 26 EO groups per molecule. As can be seen, the enzyme stabilizers (AEs) are particularly effective when the alkyl group contains 16 or more carbon atoms, e.g., 16 to 20 carbons, and the ethoxylate content is from 60–80% by weight (~12–26 EO groups), especially from 70–80% by weight (~14–26 EO groups).

Example 2

A number of experiments were conducted to determine the relationship between the amount of enzyme stabilizer (AE) needed to obtain optimum protection against loss of enzyme activity in the presence of LAS. The AE chosen had the structure shown in Formula I and contained 30% $C_{16}$ –70% $C_{18}$ with 14 mols (70% by weight) ethylene oxide. Varying molar ratios of LAS to this particular AE (constant LAS concentration, variable AE concentration) were incubated with SAVINASE 16L in the method described above and assayed for remaining protease activity. The incubation period was 60 minutes. It was observed that with an increase in the AE concentration, the LAS concentration remaining constant at 1.25 mM, remaining protease activity increased. Indeed, it was found that at a ratio of one mol of AE to five mols of LAS, there was essentially no loss of protease activity over the incubation period. It is to be noted that this experiment was conducted without other conventional enzyme stabilizers and that in the presence of such, the molar ratio of enzyme stabilizers of the present invention to anionic surfactant could be increased, e.g., to 1:8, while still affording maximum protection.

Example 3

Figure 2:
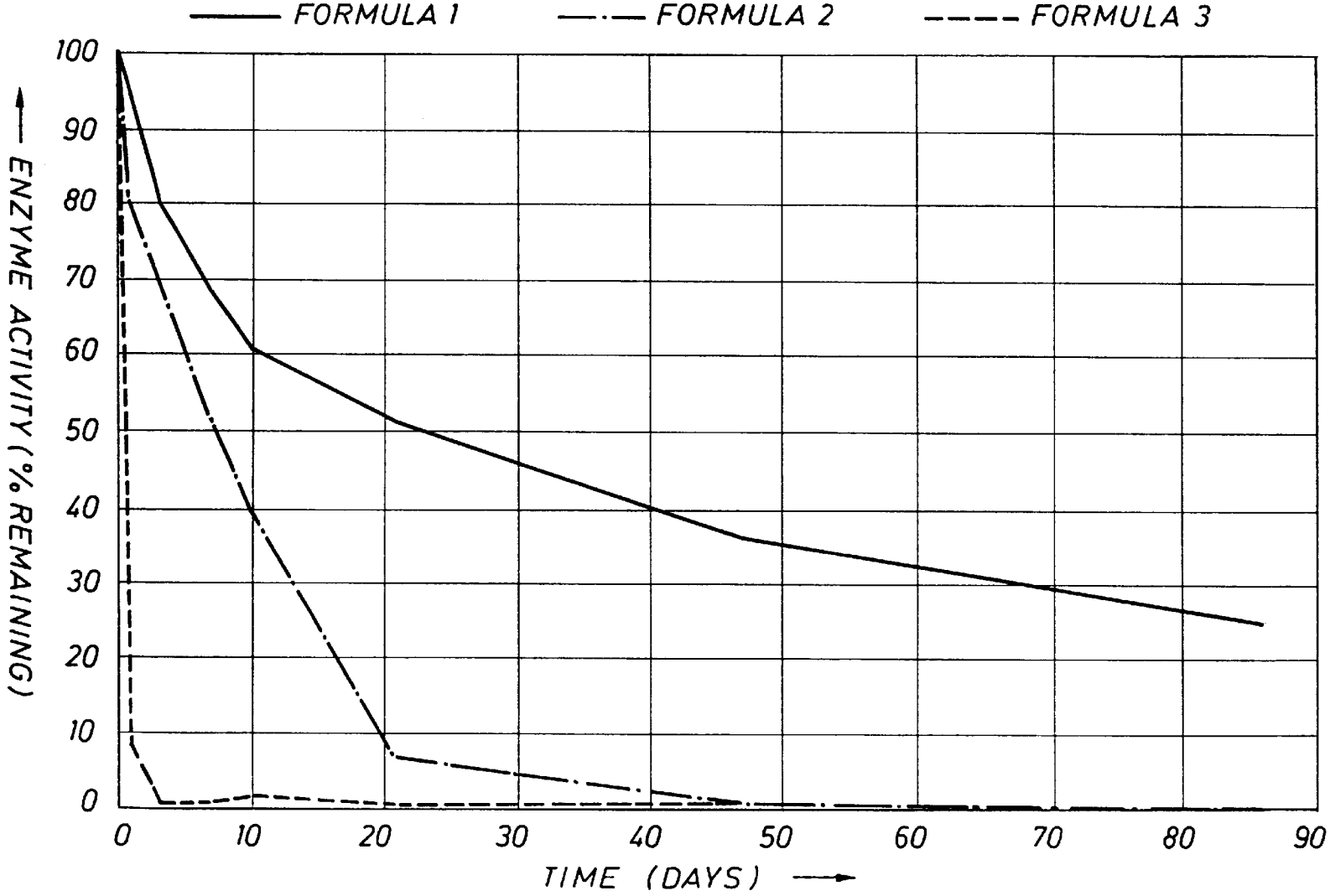
FIG. 2 is a graph comparing a nonionic surfactant similar to the enzyme stabilizers of the present invention on protease stability in detergent formulations containing LAS.

This example demonstrates tie stability of protease during storage in typical aqueous liquid detergent formulations. In order to assess the protective effect of the enzyme stabilizers of the present invention in typical HDL formulations, the AE of Example 1 was formulated in a detergent containing 30% by weight total surfactants. The formulation (Formulation 1) contained the following ingredients: surfactants (15% by weight LAS, 15% by weight AE); 3% sodium tetraborate; 5% by weight sodium citrate; 0.2% by weight sodium sulfate; 0.1% sodium chloride; 1% by weight SAVINASE 16L. The composition had a pH of 5.0. No stabilizers were added other than those present in the SAVINASE 16L preparation as received from the supplier. Two comparative detergent formulations were made as above, with the exception that in one case (Formulation 3) the surfactant comprised only 15% LAS and in the second case (Formulation 2), the surfactant comprised 15% LAS in combination with 15% by weight AE containing 70% by weight ethylene oxide, but with a $C_{12}$ residual alcohol carbon chain. As can be seen from FIG. 2, by day 3 there was no enzyme present in the formulation containing only 15% LAS (Formulation 3). This is to be contrasted with Formulation 1, which showed 80% enzyme activity remaining after three days and Formulation 2, which showed 70% enzyme activity remaining after three days. It is also to be noted that even after fifty days, Formulation 1 still possessed significant enzyme activity, whereas Formulations 2 and 3 contained essentially no enzyme activity. This further demonstrates that certain, defined alcohol ethoxyates have a marked and unexpected protective effect vis-a-vis the enzyme activity of proteolytic enzymes in liquid, anionic-surfactant-containing detergent formulations whereas other alcohol ethoxylates exhibit no appreciable effect over long storage periods.

Example 4

Figure 3:
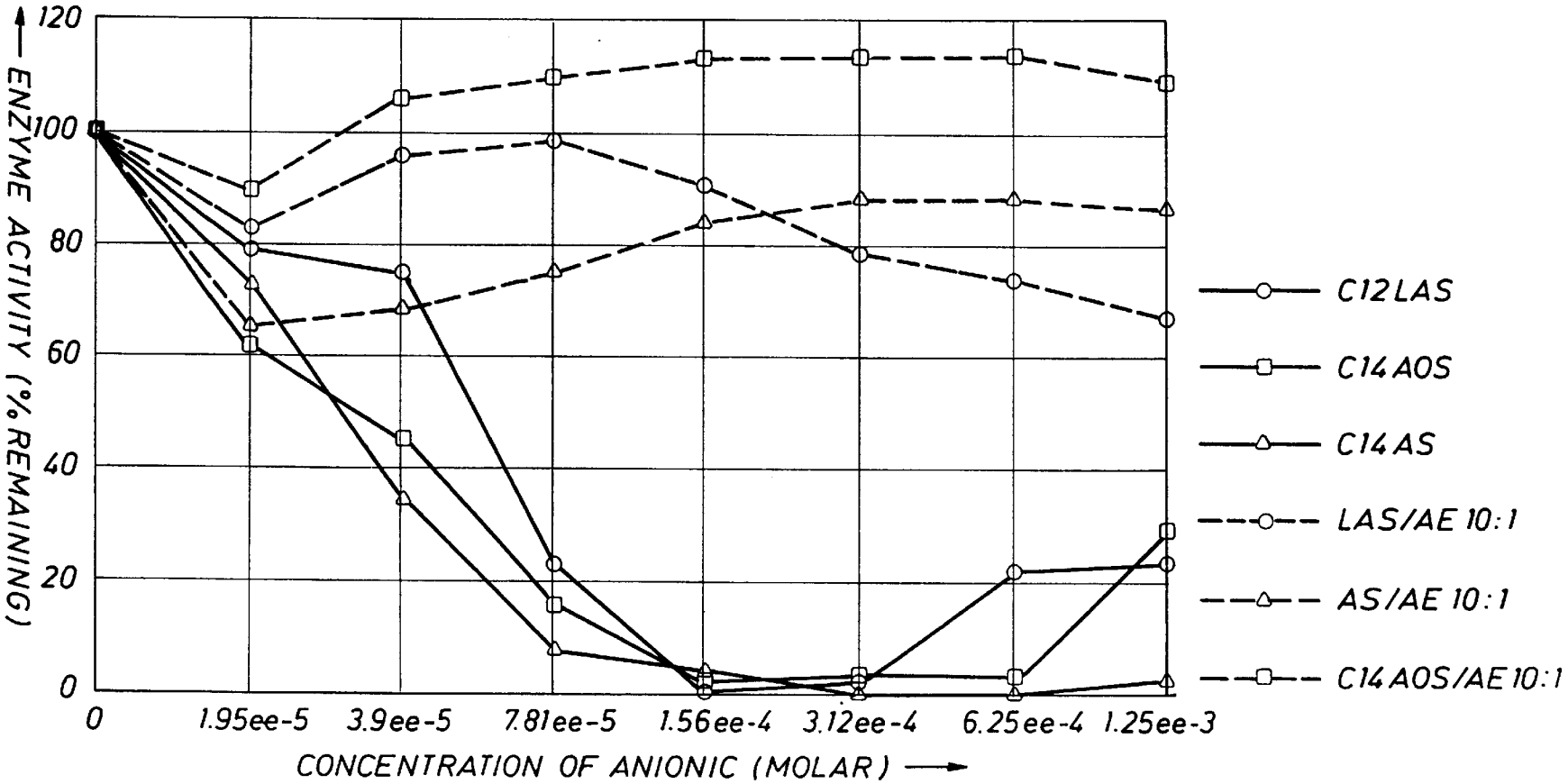
FIG. 3 is a graph showing the effect of the enzyme stabilizers of the present invention on protease activity in various anionic surfactant compositions.

This example demonstrates that the enzyme stabilizer of the present invention enhances the stability of proteolytic enzymes in the presence of anionic surfactants other than LAS. The anionic detergents tested were LAS (as used above), an alcohol sulfate (AS, sodium dodecyl sulfate), and a $C_{14}$ alpha olefin sulfate (AOS). The procedure followed was that as essentially set forth in Example 2. As can be seen from the data in FIG. 3, by incorporating the enzyme stabilizers of the present invention, in all cases, after a 60-minute incubation period, the remaining protease activity in the composition containing the enzyme stabilizer was markedly enhanced as compared with the compositions wherein the anionic surfactants were present in the enzyme compositions with no enzyme stabilizers of the present invention. In all cases, the molar ratio of anionic surfactant to AE (enzyme stabilizer) was 10:1, which suggests that HDLs can be formulated with a higher loading of anionics.

Example 5

This example demonstrates the effectiveness of other enzyme stabilizers within the scope of the present invention. The procedure of Example 2 was followed, the amount of enzymatic activity remaining after 60 minutes being determined. Results are shown in Table 1 below:

TABLE 1

| Enzyme Stabilizer | % Remaining Activity |
|---|---|
| $C_{16}$–$C_{18}$ methyl ester/14 mols EO[1] | 97.1 |
| $C_8$–$C_{10}$ methyl ester/15 mols EO[2] | 50.1 |
| $C_{20}$ Guerbet alcohol/4 mols EO[3] | 1.3 |
| $C_{20}$ Guerbet alcohol/20 mols EO[3] | 84.9 |

TABLE 1-continued

| Enzyme Stabilizer | % Remaining Activity |
|---|---|
| $C_{15}$ secondary alcohol/7 mols EO[4] | .5 |
| $C_{15}$ secondary alcohol/20 mols EO[4] | 75.4 |

[1]Has structure of Formula II wherein "R" is derived from tallow fatty acid.
[2]Has structure of Formula II wherein "R" is 30% $C_8$-70% $C_{10}$.
[3]Has structure of Formula III wherein "$R_1$" is $C_{10}$ and "$R_2$" is $C_8$.
[4]Has structure of Formula V wherein "$R_3$" is $C_{13}$ and "$R_4$" is a methyl group.

As can be seen from the above, the enzyme stabilizers of the present invention encompass a wide variety of compounds of the general formula set forth above, including ethoxylated methyl esters, ethoxylated Guerbet alcohols, and ethoxylated secondary alcohols.

Example 6

This example demonstrates the use of the enzyme stabilizers of the present invention in conjunction with other, prior art enzyme stabilizers. In this example, the AE of Example 1 was employed in varying concentrations with 15% by weight LAS. The solutions were incubated at 40° C. for two days. The results in Table 2 below show remaining protease activity using the enzyme stabilizer of the present invention with and without propylene glycol, a known prior art enzyme stabilizer. For comparative purposes, several formulations were made that contained no LAS; i.e., the formulations contained only the enzyme and inorganic salts or only the enzyme, inorganic salts, and propylene glycol.

TABLE 2

| Formulation | % Remaining Protease Activity at Day 2 |
|---|---|
| Inorganic salts[1] only | 93 |
| Inorganic salts[1] only plus 3% PG[2] | 88 |
| 15% LAS | 0 |
| 15% LAS plus 3% PG | 0 |
| 15% LAS/5% AE | 0 |
| 15% LAS/5% AE plus 3% PG | 10 |
| 15% LAS/10% AE | 24 |
| 15% LAS/10% AE plus 3% PG | 57 |
| 15% LAS/15% AE | 49 |
| 15% LAS/15% AE plus 3% PG | 70 |

[1]Sodium salts of tetraborate (3%) and citrate (5%), pH 7.
[2]PG = propylene glycol.

As can be seen, the use of the enzyme stabilizers of the present invention in conjunction with at least one prior art stabilizers exhibits a synergistic effect. Note, for example, that the formulation containing 15% LAS and 3% propylene glycol, like the formulation containing 15% LAS and 5% AE, exhibited no remaining protease activity after day 2. However, note that the formulation containing 15% LAS, 5% AE, and 3% PG showed 10% remaining protease activity at day 2. Note further that when the AE content was increased to 15% by weight and there was 3% propylene glycol present, there was a marked increase in remaining protease activity at day 2. The data in the table above show that in the presence of other, prior art enzyme stabilizers, less enzyme stabilizer of the present invention is necessary to achieve a determined degree of stabilization.

The above data clearly demonstrate that certain classes of alkoxylated nonionic surfactants act as excellent enzyme stabilizers vis-a-vis aqueous compositions containing proteolytic enzymes and anionic surfactants. The advantages of the present invention are apparent. For one, the alkoxylates that are used as the enzyme stabilizers are, in and of themselves, cleaning agents, which therefore reduces the need to incorporate into the formulations enzyme stabilizers that have no function other than reducing anionic surfactant-mediated enzyme destabilization. Additionally, the use of the alkoxylates allows for higher concentrations of anionic surfactant to be used in detergent formulation containing proteolytic enzymes.

It will be apparent that the stabilizers of the present invention are, in and of themselves, nonionic surfactants, albeit of a particular type. Thus, depending upon the particular formulation, any nonionic surfactant present in the enzyme compositions may comprise all of the enzyme stabilizers of the present invention or may contain the enzyme stabilizers of the present invention, together with other nonionic surfactants.

The foregoing description and examples illustrate selected embodiments of the present invention. In light thereof, variations and modifications will be suggested to one skilled in the art, all of which are in the spirit and purview of this invention.

What is claimed is:

1. A stable aqueous enzyme composition comprising:

(a) water;

(b) from 0.1 to about 75% by weight of a detergent surfactant selected from the group consisting of anionic surfactants and anionic surfactants and one or more non-anionic detergent actives, wherein the weight ratio of anionic surfactant to non-anionic detergent active is greater than 1: 1 when there is a mixture of anionic surfactant and non-anionic detergent active;

(c) from 0.001% to about 10% by weight proteolytic enzyme; and (d) an enzyme stabilizer in an amount effective to stabilize said enzyme, said stabilizer having the formula:

$$X—O—(C_nH_{2n}O)_a—H \quad [I]$$

wherein "X" is an organic radical having from 16 to 22 carbon atoms, "a" is an integer from 14 to 26, and "n" is an integer from 2–4, wherein said one or more non-anionic detergent actives, if present, can comprise said enzyme stabilizer, said aqueous enzyme composition having a pH of from 6 to 7.

2. The composition of claim 1 wherein said enzyme stabilizer is selected from the class consisting of compounds having the formula:

$$R—O—(C_nH_{2n}O)_a—H \quad [II]$$

wherein "R" is a linear or branched alkyl group having from 16 to 22 carbon atoms; compounds having the formula:

[III]

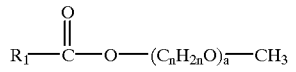

wherein "$R_1$" is a linear or branched alkyl group having from 15 to 21 carbon atoms; compounds having the formula:

[IV]

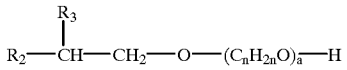

wherein "$R_2$" and "$R_3$" are linear or branched alkyl groups having, in the aggregate, from 14 to 20 carbon atoms; and compounds having the formula:

[V]

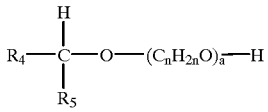

wherein "$R_4$" and "$R_5$" are linear or branched alkyl groups having, in the aggregate, from 15 to 21 carbon atoms, and mixtures thereof.

3. The composition of claim 1 wherein the mol ratio of said enzyme stabilizer to anionic surfactant is from 2:1 to 1:5.

4. The composition of claim 2 wherein said enzyme stabilizer comprises compounds having the structure of Formula II.

5. The composition of claim 2 wherein said enzyme stabilizer comprises compounds having the structure of Formula III.

6. The composition of claim 2 wherein said enzyme stabilizer comprises compounds having the structure of Formula IV.

7. The composition of claim 1 wherein said enzyme stabilizer comprises compounds having the structure of Formula V.

8. The composition of claim 1 wherein "n" is 2.

9. The composition of claim 2 wherein the enzyme stabilizer comprises compounds having the structure of Formula II and "n" is 2.

10. The composition of claim 9 wherein the mol ratio of said enzyme stabilizer to anionic surfactant is from 4:1 to 1:5.

11. The composition of claim 9 wherein the mol ratio of said enzyme stabilizer to anionic surfactant is from 2:1 to 1:5.

* * * * *

UNITED STATES PATENT AND TRADEMARK OFFICE

CERTIFICATE OF CORRECTION

PATENT NO. : 6,121,225

DATED : September 19, 2000

INVENTOR(S) : Larry N. Britton; Geoffrey L. Russell; Allen M. Nielsen

It is certified that error appears in the above-identified patent and that said Letters Patent are hereby corrected as shown below:

In column 12, line 10, change "1" to --2--.

Signed and Sealed this

Tenth Day of April, 2001

*Attest:*

Nicholas P. Godici

NICHOLAS P. GODICI

*Attesting Officer*

*Acting Director of the United States Patent and Trademark Office*